US005880760A

United States Patent [19]

Desie et al.

[11] Patent Number: 5,880,760

[45] Date of Patent: Mar. 9, 1999

[54] METHOD AND DEVICE FOR PRINTING INFORMATION ON SUBSTRATES HAVING SECURITY FEATURES

[75] Inventors: Guido Desie, Herent; Leon Vermeulen, Herenthout; Michel Boulonne, Kappelle op den Bos, all of Belgium

[73] Assignee: Agfa-Gevaert, Mortsel, Belgium

[21] Appl. No.: 868,418

[22] Filed: Jun. 3, 1997

Related U.S. Application Data

[60] Provisional application No. 60/025,321 Sep. 6, 1996.

[30] Foreign Application Priority Data

Jun. 6, 1996 [EP] European Pat. Off. ..... 96201580.6

[51] Int. Cl.[6] ..... B41J 2/06

[52] U.S. Cl. ..... 347/55; 101/DIG. 37; 283/72

[58] Field of Search ..... 347/55, 112, 149, 347/153; 101/DIG. 37, 114, 129; 283/57, 58, 72, 901

[56] References Cited

U.S. PATENT DOCUMENTS

| | | | |
|---|---|---|---|
| 3,689,935 | 9/1972 | Pressman et al. | 346/74 ES |
| 4,491,855 | 1/1985 | Fuji et al. | 346/159 |
| 4,568,955 | 2/1986 | Hosoya et al. | 346/153.1 |
| 4,626,459 | 12/1986 | Warhol | 346/74 ES |
| 4,780,733 | 10/1988 | Schmidlin | 346/160.1 |
| 4,814,796 | 3/1989 | Schmidlin | 346/155 |
| 4,912,489 | 3/1990 | Schmidlin | 346/159 |
| 5,036,341 | 7/1991 | Larsson | 346/154 |
| 5,038,159 | 8/1991 | Schmidlin et al. | 346/159 |
| 5,121,144 | 6/1992 | Larson et al. | 346/154 |
| 5,170,185 | 12/1992 | Takemura et al. | 346/140 R |
| 5,257,046 | 10/1993 | Schmidlin | 428/40 |
| 5,327,169 | 7/1994 | Thompson | 346/155 |
| 5,374,949 | 12/1994 | Wada et al. | 346/154 |
| 5,453,768 | 9/1995 | Schmidlin | 47/55 |
| 5,495,273 | 2/1996 | Kitamura | 347/55 |

FOREIGN PATENT DOCUMENTS

| | | |
|---|---|---|
| 0675417 | 3/1995 | European Pat. Off. . |
| 96 201580 | 11/1995 | European Pat. Off. . |
| 60-263962 | 12/1985 | Japan . |
| WO 93/09476 | 5/1993 | WIPO . |

*Primary Examiner*—Christopher A. Bennett
*Assistant Examiner*—Dave A. Ghatt
*Attorney, Agent, or Firm*—Baker & Botts, L.L.P.

[57] ABSTRACT

A method for printing information on a substrate having security features includes the steps of: applying a DC potential difference ($DC_{TB}$) between a back electrode and a toner delivery means to create a flow of toner particles from the toner delivery means to the back electrode; interposing a printhead structure, the printhead structure having printing apertures and control electrodes around the printing apertures, between the toner delivery means and the back electrode so as to create a spacing having a width L between the printhead structure and the back electrode and to imagewise control the flow of toner particles; passing the substrate having a thickness T in $\mu$m through the spacing; adjusting the spacing between the printhead structure and the back electrode such that the width of the spacing L is greater than or equal to 1.5 T; adjusting the DC potential difference ($DC_{TB}$) such that the relationship $|DC_{TB}|/L$, expressed in volts per micrometer (V/$\mu$m), is greater than or equal to 1.0; imagewise depositing the toner particles on the substrate through the printing apertures; and fixing the toner particles to the substrate.

18 Claims, 1 Drawing Sheet

METHOD AND DEVICE FOR PRINTING INFORMATION ON SUBSTRATES HAVING SECURITY FEATURES

This application claims the benefit of U.S. Provisional application Ser. No. 60/025,321 filed Sep. 6, 1996.

FIELD OF THE INVENTION

The present invention relates to an apparatus for Direct Electrostatic Printing (DEP). It relates in particular to a DEP device especially useful for printing on substrates incorporating security features.

BACKGROUND OF THE INVENTION

Passports, visas, identity cards, driver licenses, bank cards, credit cards, security entrance cards, etc, must be made forgery-free to avoid fraudulent use. Therefore not only the finished document comprises security features, but also the paper on which such documents are printed comprises several security features. Such features are inclusions of materials in the bulk of the paper, e.g. watermarks, special relief patterns on the paper surface, fibres, security threads, light diffraction marks, etc. Paper including such security features does not present an even smooth surface for printing and therefore it is not very straightforward to print even density patches on security paper when using contact-printing methods.

Logically then, methods for printing on security paper are to be found in the field of non-impact printing. Among the most common methods of non-impact printing are electro (photo)graphy, ink-jet printing, thermosublimlation printing and Direct Electrostatic (DEP).

Thermosublimation printing is not well suited for printing on rough surfaces and mostly a dye acceptor layer is necessary on the substrate. Thermosublimation printing, that proceeds by thermally evaporating solid dye or pigments, is not very well suited for security printing because of the dyes, usually used, are not sufficiently waterfast and lightfast, and are characterize by high bleeding, leading to documents with a restricted shelf life. Thermosublimation printing does thus not offer an adequate possibility for printing on security paper.

Ink-jet printing offers at first sight interesting possibilities for printing on paper with a very rough surface, but is not very well suited for printing security documents. The dyes or pigments, usually used in ink-jet printing, are not sufficiently waterfast and lightfast to be used in security documents. Moreover, in ink-jet printing also, an ink-receiving layer is necessary on the substrate.

Therefore electro(photo)graphic and Direct Electrostatic Printing are preferred non-impact printing methods for security printing. The advantage of these methods is that they use pigmented and/or dyed toner particles that are fused to the substrate, and that in the preparation of said toner particles the chemical structure of the pigments or dyes (chemical structure defining largely the water- and lightfastness) that are used is not very critical. Thus in the production of toner particles a wide range of different pigments and dyes can be used. It is, e.g., possible to incorporate nacreous, iridescent or interference pigments, etc, in the toner particles, without interfering with the usefulness of this toner particles in the printing methods.

In electro(photo)graphy an image is first formed on a latent image bearing member and then transferred to a substrate, which in this case is a security paper with a rough surface. The transferring step is still a contact step and therefore the image of even density patches on the substrate, having a rough substrate or comprising watermarks, is not very faithful.

From the printing methods using toner particles to form an image, DEP has the advantage to be a real non-impact method and is therefore the preferred method for printing on security paper having a rough surface.

The DEP method is a well known printing method, a DEP printing device is disclosed in e.g. U.S. Pat. No. 3,689,935. This document discloses an electrostatic line printer having a multi-layered particle modulator or printhead structure comprising:

- a layer of insulating material, called isolation layer;
- a shield electrode consisting of a continuous layer of conductive material on one side of the isolation layer;
- a plurality of control electrodes formed by a segmented layer of conductive material on the other side of the isolation layer; and
- at least one row of apertures.

Each control electrode is formed around one aperture and is isolated from each other control electrode.

Selected potentials are applied to each of the control electrodes while a fixed potential is applied to the shield electrode. An overall applied propulsion field between a toner delivery means (toner source) and a receiving member support projects charged toner particles through a row of apertures of the printhead structure. The intensity of the particle stream is modulated according to the pattern of potentials applied to the control electrodes. The modulated stream of charged particles impinges upon a receiving member substrate, interposed in the modulated particle stream. The receiving member substrate is transported in a direction orthogonal to the printhead structure, to provide a line-by-line scan printing. The shield electrode may face the toner delivery means (toner source) and the control electrode may face the receiving member substrate. A DC field is applied between the printhead structure and a single back electrode on the receiving member support. This propulsion field is responsible for the attraction of toner to the receiving member substrate that is placed between the printhead structure and the back electrode. Due to the electrical nature of said imaging process, accurate control of the distance of said printhead structure to said toner application module and said image receiving layer is very important.

Several modifications on the basic design of U.S. Pat. No. 3,689,935 have been proposed, mainly to overcome four major problems:

- presenting an uniform cloud of toning particles to the printhead.
- supplying sufficient charged toning particles to the printhead structure, without scattering them or without contaminating the printhead structure and the engine environment.
- prevent clogging of the apertures in the printhead structure
- avoiding the deposition of wrong sign particles on the printhead structure, the repelling state for particles with the right sign corresponds to an attraction state for wrong sign particles.

Typical examples of modification are disclosed in, e.g., GB 2,108,432, DE-OS 3,411,948, U.S. Pat. No. 4,780,733, U.S. Pat. No. 4,814,796, U.S. Pat. No. 4,912,489, U.S. Pat. No. 5,038,159, U.S. Pat. No. 5,036,341, U.S. Pat. No. 5,121,144, U.S. Pat. No. 5,170,185, U.S. Pat. No. 5,281,982 and many others. In these disclosure the toner particles are presented in the vicinity of a printhead structure via a toner delivery means bringing only toner particles in the vicinity of the printhead structure. In U.S. Pat. No. 5,327,169, EP-A 675 417 and JP-A 60/263962, is disclosed wherein developer, i.e. not only toner particles but also carrier particles, is presented in the vicinity of the printhead structure directly with a magnetic brush.

All the DEP devices, disclosed in the references above, have in common that between the surface of the printhead structure, facing the back electrode and the surface of the back electrode an air gap exists through which the substrate can pass and the toner particles fly over this air gap from the printhead structure on to said substrate. Most of the disclosures remain silent over the width of the air gap. In EP-A 675 417 a gap of 150 μm is disclosed, in U.S. Pat. No. 5,257,046 a gap between 127 μm and 762 μm is disclosed and in JP-A 60/263962 a gap of 600 μm is disclosed.

For printing on security paper, that is paper comprising various security features and that a.o. can comprise watermarks and/or can be both quite thick and have large thickness variations in the order of tens and even hundreds of μm, the DEP devices disclosed earlier do not give optimum results.

SUMMARY OF THE INVENTION

It is an object of the invention to provide a method for printing with high density and high spatial resolution at a final receiving member comprising security features.

It is a further object of the invention to provide a fast printing method for printing with high density, with low density fluctuations in even density patches and high resolution on various substrates with changing thickness, flexibility, composition, etc.

It is a further object of the invention to provide a DEP device combining said possibility of printing on various substrates with changing thickness, flexibility, composition, etc. and optionally comprising various security features, with high spatial and density resolution, with good long term stability and reliability.

Further objects and advantages of the invention will become clear from the description hereinafter.

The above objects are realized by providing a method for printing information on a substrate comprising security features comprising the steps of:

i) applying a DC potential difference ($DC_{TB}$) between a back electrode (105) and a means for delivering toner particles (101) and creating a flow of toner particles (104) from said means for delivering toner particles to said back electrode;

ii) interposing a printhead structure (106), having printing apertures (107) and control electrodes (106*a*) around said printing apertures, between said means for delivering toner particles to said back electrode leaving a spacing with a width L in μm between said printhead structure and said back electrode, for image wise controlling said flow of toner particles;

iii) passing a substrate (109), comprising security features and having thickness T in μm, in said spacing, having a width L in μm, between said printhead structure and said back electrode;

iv) image wise depositing toner particles on said substrate through said printing apertures and v) fixing said toner particles to said substrate.

Preferably width of said spacing, L, relates to said thickness, T, of said substrate so that $L \geqq 1.5$ T. In a further preferred embodiment, said DC potential difference ($DC_{TB}$) is such that $|DC_{TB}|/L \geqq 1.0$, where $|DC_{TB}|/L$ is expressed in V/μm. Further objects of this invention are realized by providing a DEP device comprising:

means (V4 and V1) for providing a DC potential difference ($DC_{TB}$) between a back electrode (105) and means for delivering toner particles (101) and for creating a flow of toner particles (104) from said means for delivering toner particles towards said back electrode, a printhead structure (106), having printing apertures (107) and control electrodes (106*a*) around said printing apertures, interposed between said means for delivering toner particles to said back electrode and being spaced from said back electrode by a spacing having an adjustable width L in μm, for image wise controlling said flow of toner particles, means (108) for passing a substrate, having thickness T in μm, in said spacing L between said back electrode and said printhead structure, means (111) for adjusting said width L in such a way that $L \leqq 1.5$ T, and means (110) for fixing said toner particles to said substrate.

Hereinafter the wording "toner delivery means" will be used to indicate said means for delivering toner particles.

BRIEF DESCRIPTION OF THE DRAWING

For a complete understanding of the present invention and the advantages thereof, reference is now made to FIG. 1, which shows a DEP device for implementing a preferred method of the present invention.

DETAILED DESCRIPTION OF THE INVENTION

Figure 1:
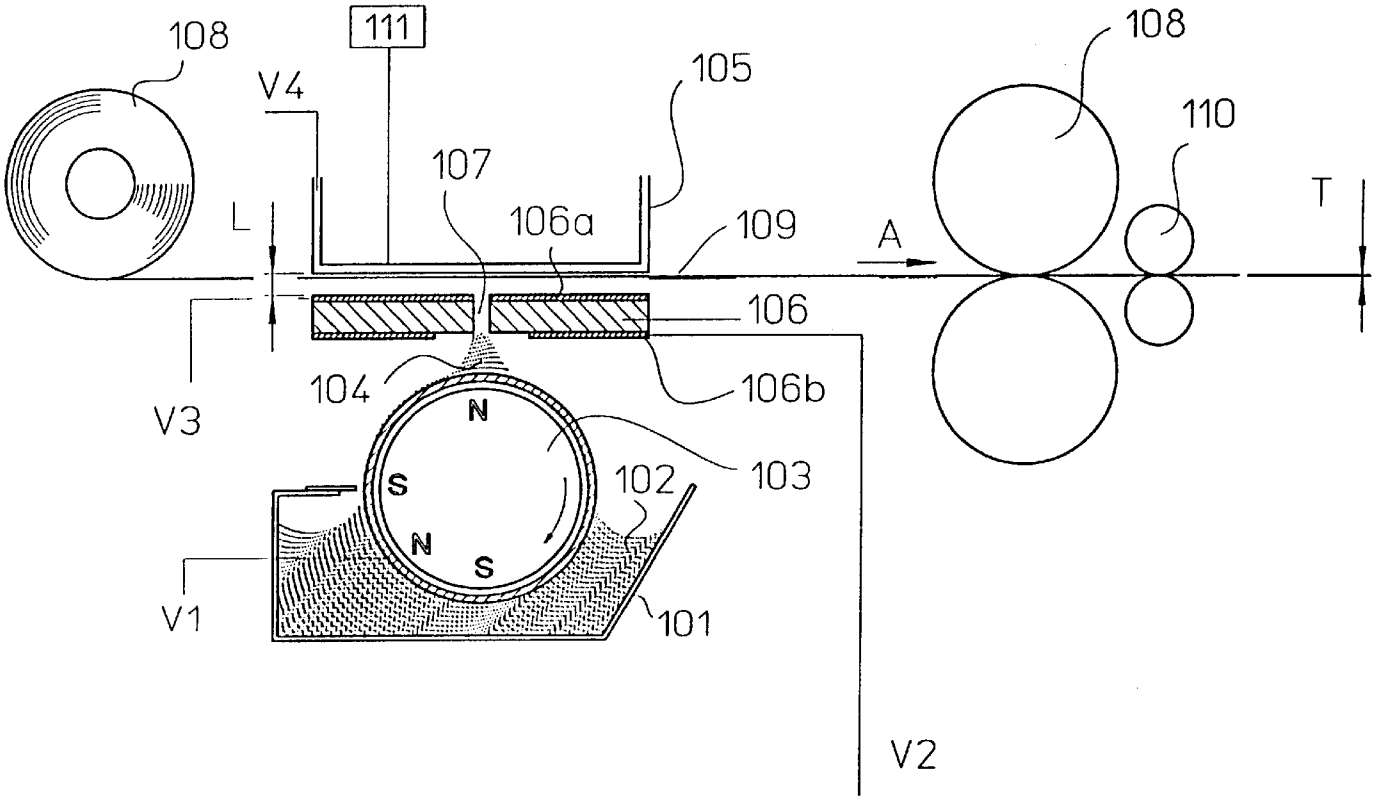

It was found that Direct Electrostatic Printing proved to be an excellent printing method for printing on a substrate comprising security features. Especially when the printing had to proceed on substrates comprising a watermark, fibres (natural, metallic, polymeric fibres) in the bulk of the substrate giving rise to larger thickness variations in the substrate, then DEP printing proved to be superior to classical electrostatic printing. The printing could proceed by any DEP device where the distance L in μm between the surface of the printing structure facing the back electrode (back side of the printhead structure) and the surface of the back electrode facing the printhead structure (front side of the back electrode) was large enough to let the substrate comprising security features pass. It was however found that a distance L being at least 1.5 times larger than the largest thickness (T in μm) of the substrate yielded the better results than when the distance L was lower than 1.5 times the largest thickness of the substrate. In a preferred embodiment of the invention, $L \geqq 2$ T.

The maximum thickness T of substrates comprising security features can easily reach 500 μm, which includes that L is then preferably at least 750 μm, or more preferably at least 1000 μm. It was found that printing quality, in terms of sharpness, resolution and fidelity of line reproduction, in DEP devices wherein the distance L between the printhead structure and the back electrode was larger than 500 μm was became very acceptable when between said back electrode and said toner delivery means a DC potential difference ($DC_{TB}$) such that $|DC_{TB}|/L \geqq 1.0$, where $|DC_{TB}|/L$ is expressed in V/μm. When $|DC_{TB}|/L$ was $\geqq 1$, it was possible to print when L, the distance between the back side of the printhead structure and the front side of the back electrode, was up to 5000 $\mu$m. The value of $DC_{TB}$ is taken as absolute value ($|DC_{TB}|$) since the value of that potential difference can be either positive or negative, depending on the sign of the charge of the toner particles that are used in the device or method of his invention.

A DEP device according to the present invention could especially well be used for printing on a substrate comprising a watermark and/or wherein thickness variations between 10% and 60% of the average thickness of the substrate are present. Even when the thickness variations were form 10% up to 80% and even from 10% up to 90% even density printing was still possible. The substrates carrying security features can be any substrate known in the art of security printing, e.g. paper, cardboard, plastic, etc. The security features can be any known security feature known in the art, e.g. watermarks, incorporated fibres, both metallic and non-metallic, micro-relief printings, etc. Typical security papers are available through Portals (Bathford) Ltd, 253 London Road East, Batheaston, Bath, Avon, England.

Description of the DEP Device

It is also an object of the present invention, to provide a DEP device combining said possibility of printing on various substrates with changing thickness, flexibility, composition, etc. and optionally comprising various security features, with high spatial and density resolution, with good long term stability and reliability. Therefore, this invention provides a DEP (Direct Electrostatic Printing) device, as shown in FIG. 1, comprising:

- a back electrode (105) spaced from a printhead structure (106) by a spacing having an adjustable width L in $\mu$m,
- means (108) for passing a substrate (109), having thickness T in $\mu$m, in said spacing between said back electrode and said printhead structure,
- means (111) for adjusting said width L in such a way that $L \geqq 1.5$ T,
- printing apertures (107) in said printhead structure,
- means for providing a DC potential difference ($DC_{TB}$) between said back electrode and a toner delivery means (101), this is the potential difference between V4 and V1 in FIG. 1, creating a flow of toner particles (104) from said toner delivery means towards said back electrode,
- means (106*a*) for image wise modulating said flow of toner particles through said printing apertures and image wise depositing said toner particles on said substrate and
- means (110) for fixing said toner particles to said substrate.

A DEP device wherein the width, L, of the spacing between the back electrode and the printhead structure is not adjustable, but fixed with $L \geqq 1.5$ T, belongs also to the scope of the invention.

The means (111) for adjusting the width of spacing L, between the back electrode and the printhead structure can be any means known in the art for adjusting distances on a micrometer scale. Very suitable means for adjusting the width, L, are e.g. a micrometer screw, stepping motor, a system based on levers, interposition of calibrated spacers, etc. In FIG. 1, although the means (111) for adjusting the spacing L are shown to be operative on the back electrode (105), a DEP device wherein said means (111) for adjusting the spacing L operate on the printhead structure (106) and a DEP device wherein said means (111) for adjusting the spacing L operate both on the back electrode (105) and the printhead structure (106) are also within the scope of this invention.

The means (106*a*) for imagewise modulating said flow of toner particles is a complex addressable electrode structure, hereinafter called "control electrode" around apertures (107), facing, in the shown embodiment, the toner-receiving member in said DEP device. The control electrode can be an individual control electrode around each individual aperture, or can be an electrode controlling the toner flow through a plurality of printing apertures.

The printhead structure (106), shown in FIG. 1, is made from a plastic insulating film, coated with a metallic film formed from a electroless deposition step on a thin layer of catalyst. The printhead structure (106) comprises a complex addressable electrode structure, the "control electrode" (106*a*) around printing apertures (107), facing, in the shown embodiment, the toner-receiving member in said DEP device. Said printing apertures are arranged in an array structure for which the total number of rows can be chosen according to the field of application. In FIG. 1 a second conductive layer is present on the other side of said plastic material, said second conductive layer being called the shield electrode layer (106*b*).

Although in FIG. 1 an embodiment of a device for a DEP method using two electrodes (106*a* and 106*b*) on printhead 106 is shown, it is possible to implement a DEP method with different constructions of the printhead (106). It is, e.g. possible to implement a DEP method with a device having a printhead comprising only one electrode structure (the control electrode (106*a*) or with more electrode structures. The apertures in these printhead structures can have a constant diameter, or can have a broader entrance or exit diameter.

The toner delivery means (101) in FIG. 1, comprises a container for developer (102) and a magnetic brush (103). From this magnetic brush the toner cloud (104) is formed. The formation of said toner cloud is preferably aided by an AC bias on the sleeve of the magnetic brush. The toner cloud directly formed from magnetic brush (103) may originate from a mono-component or from a multi-component developer. DEP device were the toner delivery means is a magnetic brush carrying a multi-component developer are described in U.S. Pat. No. 5,327,169, EP-A 675 417 and JP-A 60/263962. The toner delivery means in a DEP device according to this invention can also comprise a toner delivery means, comprising a container for developer, a charged toner conveyer (CTC) and a magnetic brush. This magnetic brush forms a layer of charged toner particles upon said charged toner conveyer and from said charged toner conveyer a toner cloud (104) is formed in the vicinity of the printing apertures (107). A DEP device, wherein a toner delivery means, comprising a container for developer, a charged toner conveyer (CTC) and a magnetic brush, is used has been disclosed in e.g. EP-A 740 224. When a DEP device with a CTC is used, it can be operated successfully when a single magnetic rush or several magnetic brushes are used in contact with a Charged Toner Conveyor (CTC) to provide a layer of charged toner on said CTC. When a DEP device using a CTC as toner source is used in a DEP device according to this invention, it is possible to successfully use non-magnetic mono-component developers. In a DEP device using a CTC as toner source, the formation of the toner cloud can be aided by applying an AC-bias on the CTC. It is in such a device also possible to connect an additional AC-source can also be to the sleeve of the magnetic brush, aiding the application of a toner layer to the charged toner conveyer.

The back electrode (105) of this DEP device can also be made to cooperate with the printhead structure, said back electrode being constructed from different styli or wires that are galvanically isolated and connected to a voltage source as disclosed in e.g. U.S. Pat. No. 4,568,955 and U.S. Pat. No. 4,733,256. The back electrode, cooperating with the printhead structure, can also comprise one or more flexible PCB's (Printed Circuit Board)

In FIG. 1, the substrate (109) is shown as a web. It is clear that a DEP device and method according to the present invention can as well be operated for printing substrates in sheet form.

Between said printhead structure (106) and the sleeve of magnetic brush (103) as well as between the control electrode around the apertures (107) and the back electrode (105) behind the toner receiving member (109) different electrical fields (DC-fields) are applied. In the specific embodiment of a DEP device, according to the present invention, shown in FIG. 1. voltage V1 is applied to the sleeve of the magnetic brush (103), voltage V4 is applied to the backelectrode (105). The DC potential difference (V4–V1) is the potential difference ($DC_{TB}$) applied between the toner delivery means (101) and the back electrode (105), creating a flow of toner particles from said cloud towards said back electrode. Voltages $\mathbf{V3}_0$ up to $\mathbf{V3}_n$ are applied to the control electrode (106*a*). The value of V3 is selected, according to the modulation of the image forming signals, between the values $\mathbf{V3}_0$ and $\mathbf{V3}_n$, on a timebasis or grey-level basis. Voltage V4 is applied to the back electrode behind the toner receiving member. In other embodiments of the present invention multiple voltages $\mathbf{V4}_0$ to $\mathbf{V4}_n$ can be used. Voltage V2 is applied to the shield electrode (106*b*).

The DEP device for printing on substrates comprising security features can in fact be any DEP device known in the art. E.g., it can be a DEP device wherein the toner cloud in the vicinity of the printhead structure is provided directly from a magnetic brush with a multi-component developer; such devices are described in U.S. Pat. No. 5,327,169, EP-A 675 417 and JP-A 60/263962. Other useful modifications in a DEP device for printing on substrates comprising security features, are a.o. the modifications described in e.g. EP-A 780 740, EP-A 763 785, EP-A 754 557, EP-A 753 413 and EP-A 731 394.

When a magnetic brush is used in a DEP device according to the present invention, be it in an embodiment as shown in FIG. 1 or be it a magnetic brush applying a layer of charged toner particles on a CTC, it is preferably of the type with stationary core and rotating sleeve.

In a DEP device, according to of the present invention and using a magnetic brush of the type with stationary core and rotating sleeve, any type of known carrier particles and toner particles can successfully be used. It is however preferred to use "soft" magnetic carrier particles. "Soft" magnetic carrier particles useful in a DEP device according to a preferred embodiment of the present invention are soft ferrite carrier particles. Such soft ferrite particles exhibit only a small amount of remanent behaviour, characterised in coercivity values ranging from about 50 up to 250 Oe (3.98 kA/m to 19.92 kA/m). Further very useful soft magnetic carrier particles, for use in a DEP device according to a preferred embodiment of the present invention, are composite carrier particles, comprising a resin binder and a mixture of two magnetites having a different particle size as described in EP-B 289 663. The particle size of both magnetites will vary between 0.05 and 3 $\mu$m. The carrier particles have preferably an average volume diameter ($d_{v50}$) between 10 and 300 $\mu$m, preferably between 20 and 100 $\mu$m. More detailed descriptions of carrier particles, as mentioned above, can be found in EP-A 675 417, that is incorporated herein by reference.

It is preferred to use in a DEP device according to the present invention, developers wherein the toner particles have an absolute average charge to mass ratio ($|q|$) to 2 $\mu C/g \leqq |q| \leqq 15\ \mu C/g$, preferably to $5\ \mu C/g \leqq |q| \leqq 8\ \mu C/g$. The absolute average charge to mass ratio was measured by mixing a mixture toner particles (4 to 8% by weight) and carrier particles in a standard tumbling set-up for 10 min. The developer mixture was run in the development unit (magnetic brush assembly) for 5 minutes, after which the toner particles were, via a magnetic brush assembly, applied as a monolayer of charged toner particles on a charged toner conveyer (a CTC). From said CTC the toner particles were under vacuum pulled to an accurately weighed filter paper (weight was WP in g), which was shielded in a Faraday cage. The amount of charge that arrived, after 5 minutes vacuum pulling, at said filter paper was measured with a Coulomb meter in $\mu$C. The filter paper with the toner particles was weighed again, giving weight WPT in g. The charge to mass ratio was then determined as $\mu$C/(WPT–WP).

Moreover it is preferred that the charge distribution, measured, as described in EP-A 675 417 is narrow, i.e. shows a distribution wherein the coefficient of variability ($\nu$), i.e. the ratio of the standard deviation to the average value, is equal to or lower than 0.33, preferably equal to or lower than 0.25. Means for producing toner particles with a low average charge and a narrow charge distribution have been disclosed, for positively chargeable toners in EP-B 654 152 and for negatively chargeable toners in EP-B 650 609 and EP-A 650 610. This three references are incorporated herein by reference. In essence the method for producing toners with low average charge and narrow charge distribution consists in mixing in the toner resin a compound having a volume resistivity lower than the volume resistivity of the toner resin. Preferred compound having lower volume resistivity than the toner resin are onium compounds. Preferably the toner particles used in a device according to the present invention have an average volume diameter ($d_{v50}$) between 1 and 20 $\mu$m, more preferably between 3 and 15 $\mu$m.

A DEP device making use of the above mentioned marking toner particles can be addressed in a way that enables it to give black and white. It can thus be operated in a "binary way", useful for black and white text and graphics and useful for classical bilevel halftoning to render continuous tone images.

A DEP device according to the present invention is especially suited for rendering an image with a plurality of grey levels. Grey level printing can be controlled by either an amplitude modulation of the voltage V3 applied on the control electrode (106*a*) or by a time modulation of V3. By changing the duty cycle of the time modulation at a specific frequency, it is possible to print accurately fine differences in grey levels. It is also possible to control the grey level printing by a combination of an amplitude modulation and a time modulation of the voltage V3, applied on the control electrode.

The combination of a high spatial resolution and of the multiple grey level capabilities typical for DEP, opens the way for multilevel halftoning techniques, such as e.g. described in EP-A 634 862. This enables the DEP device, according to the present invention, to render high quality images.

Printing examples were made by an apparatus using a developer, comprising toner and carrier particles, as described further on.

EXAMPLES

The DEP Device

The DEP device used is essentially a device as shown in FIG. 1. A printhead structure (106) made from a polyimide film of 50 μm thickness, double sided coated with a 17.5 μm thick copper film. The printhead structure (106) had four rows of printing apertures. On the back side of the printhead structure, facing the receiving member substrate, a square shaped control electrode (106*a*) was arranged around each aperture. Each of said control electrodes was individually addressable from a high voltage power supply. On the front side of the printhead structure, facing the toner delivery means, a common shield electrode (106*b*) was present. The printing apertures had an aperture width of 100 μm. The width of the copper electrodes was 50 μm. The rows of printing apertures were staggered to obtain an overall resolution of 254 dpi (dots per inch or dots per 25.4 mm).

The toner delivery means (101) comprised a stationary core/rotating sleeve type magnetic brush (103) comprising two mixing rods and one metering roller. One rod was used to transport the developer through the unit, the other one to mix toner with developer.

The magnetic brush assembly (103) was constituted of the so called magnetic roller, which in this case contained inside the roller assembly a stationary magnetic core, showing nine magnetic poles of 500 Gauss (0.05 T) magnetic field intensity and with an open position to enable used developer to fall off from the magnetic roller. The magnetic roller contained also a sleeve, fitting around said stationary magnetic core, and giving to the magnetic brush assembly an overall diameter of 20 mm. The sleeve was made of stainless steel roughened with a fine grain to assist in transport (<50 μm).

A scraper blade was used to force developer to leave the magnetic roller. And on the other side a doctoring blade was used to meter a small amount of developer onto the surface of said magnetic brush assembly. The sleeve was rotating at 100 rpm, the internal elements rotating at such a speed as to conform to a good internal transport within the development unit. The magnetic brush assembly (103) was connected to an AC power supply with a square wave oscillating field of 600 V at a frequency of 3.0 kHz with 0 V DC-offset. This AC field and the DC-offset are the voltage V1 of FIG. 1.

The Toner

The toner used for the experiment had the following composition: 97 parts of a co-polyester resin of fumaric acid and propoxylated bisphenol A, having an acid value of 18 and volume resistivity of $5.1\times10^{16}$ ohm.cm was melt-blended for 30 minutes at 110° C. in a laboratory kneader with 3 parts of Cu-phthalocyanine pigment (Colour Index PB 15:3). A resistivity decreasing substance—having the following structural formula: $(CH_3)_3N^+C_{16}H_{33}Br^-$ was added in a quantity of 0.5% with respect to the binder. It was found that—by mixing with 5% of said ammonium salt—the volume resistivity of the applied binder resin was lowered to $5\times10^{14}$ Ω.cm. This proves a high resistivity decreasing capacity (reduction factor: 100).

After cooling, the solidified mass was pulverized and milled using an ALPINE Fliessbettgegenstrahlmühle type 100AFG (tradename) and further classified using an ALPINE multiplex zig-zag classifier type 100MZR (tradename). The resulting particle size distribution of the separated toner, measured by Coulter Counter model Multisizer (tradename), was found to be 6.3 μm average by number and 8.2 μm average by volume. In order to improve the flowability of the toner mass, the toner particles were mixed with 0.5% of hydrophobic colloidal silica particles (BET-value 130 $m^2/g$).

The Carrier Particles

A macroscopic "soft" ferrite carrier consisting of a MgZn-ferrite with average particle size 50 μm, a magnetisation at saturation of 29 emu/g (36.25 $\mu T.m^3/kg$) was provided with a polymeric silicon coating of 0.6% by weight (w/w), with respect to the total weight of the carrier core. The polymeric silicon coating comprised between 0 and 30% by weight, with respect to the total coating, of aminosilane compounds. Such carriers have been described in EP-A 650 099. The material showed virtually no remanence.

The Developers

Four different electrostatographic developers were prepared by mixing said mixture of toner particles and colloidal silica in a 4 to 8% ratio (w/w) with carrier particles. The tribo-electric charging of the toner-carrier mixture was performed by mixing said mixture in a standard tumbling set-up for 10 min. The developer mixture was run in the development unit (magnetic brush assembly) for 5 minutes, after which the toner was sampled and the tribo-electric properties were measured, according to the methods as described herein above. The aminosilane content in % by weight of the coatings of the carrier particles used to prepare the various developers, the toner concentration in % by weight, the charge to mass ratio (μC/g) of the toner particles and the charge distribution of the toner particles as coefficient of variability ν are given in table 1.

TABLE 1

| Developer | weight % aminosilane | weight % toner | Charge/mass in μC/g | ν |
|---|---|---|---|---|
| D1 | 0 | 8 | −5.6 | 0.321 |
| D2 | 0 | 5 | −7.0 | 0.251 |
| D3 | 14 | 4 | −13.7 | 0.172 |
| D4 | 30 | 4 | −36 | 0.200 |

The distance l between the front side of the printhead structure (106) and the sleeve of the magnetic brush assembly (103), was set at 450 μm. The distance L between front side of the back electrode (105) and the back side of the printhead structure (106) (i.e. control electrodes 106*a*) was adjusted to the thickness of the substrate to be printed and said substrate travelled at 1 cm/sec. The shield electrode (106*b*) was grounded: V2=0 V. To the individual control electrodes an (imagewise) voltage V3 between 0 V and −300 V was applied. The back electrode (105) was connected to a high voltage power supply that applied a voltage ($DC_{TB}$) such that in each printing example $DC_{TB}/L$ was equal to or larger than 1. To the sleeve of the magnetic brush an AC voltage of 600 V at 3.0 kHz was applied, with a DC offset of −50 V.

Printing Examples

With the various toners even density patches were printed, together with lines that were intended to have a width of 100 μm. The evenness of the density patches was judged visually and given a quotation from 1 (very good) to 5 (very bad). The actual width of the printed lines was measured with a microdensitometer. The results are tabulated in table 2.

Example 1

Printing proceeded, with a DEP device as described above, on a substrate (STEINBACH PAPER) with thickness 300 μm, and thickness variations as $R_{max}$ of 57 μm at a distance L of 1000 μm with developer D1. The DC potential difference, $DC_{TB}$, between the back electrode and the toner delivery means was 1500 V, giving a $DC_{TB}/L$ of 1.5.

Example 2

Example 1 was repeated, except for the developer that was used, instead of developer D1, developer D2 was used.

Example 3

Example 1 was repeated, except for the developer that was used, instead of developer D1, developer D3 was used.

Example 4

Example 1 was repeated, except for the developer that was used, instead of developer D1, developer D3 was used.

Example 5

Example 1 was repeated, except for $DC_{TB}$, instead of being 1500 V, $DC_{TB}$ was 400 V, giving a $DC_{TB}/L$ of 0.4.

Example 6

Example 1 was repeated, but the printing proceeded on paper comprising a water mark.

Comparative example 1 (CE1)

Printing with a classical electrophotographic copier (CANON NP6650, tradename) and with a commercially available toner proceeded on the same substrate as used in example 1.

TABLE 2

| Ex # | Dev* | L† in μm | $\lvert DC_{TB}\rvert/L^{+}$ | Evenness | Line width in μm |
|---|---|---|---|---|---|
| 1 | D1 | 1000 | 1.5 | 1 | 102 |
| 2 | D2 | 1000 | 1.5 | 1 | 110 |
| 3 | D3 | 1000 | 1.5 | 2 | 150 |
| 4 | D4 | 1000 | 1.5 | 3 | 280 |
| 5 | D1 | 1000 | 0.4 | 3 | 230 |
| 6 | D1 | 1000 | 1.5 | 1 | 102 |
| CE1 | CT** | na | na | 5 | 102 |

*Dev = developer, particulars of the developers in table 1.
†distance between the back side of the printhead structure and the front side of the back electrode.
+: $\lvert DC_{TB}\rvert$ the potential difference between the back electrode and the toner delivery means.
**commercial developer sold in connection with a CANON NP6650 (tradename) classical photocopier.
na: not applicable.

We claim:

1. A method for printing information on a substrate having security features, comprising the steps of:

applying a DC potential difference ($DC_{TB}$) between a back electrode and a toner delivery means to create a flow of toner particles from said toner delivery means to said back electrode;

interposing a printhead structure, said printhead structure having printing apertures and control electrodes around said printing apertures, between said toner delivery means and said back electrode so as to create a spacing having a width L in μm between said printhead structure and said back electrode and to imagewise control said flow of toner particles;

passing said substrate having a thickness T in μm through said spacing between said printhead structure and said back electrode;

adjusting said spacing between said printhead structure and said back electrode such that $L \geqq 1.5\ T$;

adjusting said DC potential difference ($DC_{TB}$) such that $\lvert DC_{TB}\rvert/L \geqq 1.0$, wherein $\lvert DC_{TB}\rvert/L$ is expressed in volts per micrometer (V/μm);

imagewise depositing said toner particles on said substrate through said printing apertures; and fixing said toner particles to said substrate.

2. The method according to claim 1, wherein L is greater than or equal to 750 μm.

3. The method according to claim 1, wherein L is greater than or equal to 1000 μm.

4. The method according to claim 1, wherein said toner particles have a charge to mass ratio, in absolute value, within the range $2\ \mu C/g \leqq \lvert g\rvert \leqq 15\ \mu C/g$.

5. The method according to claim 4, wherein said toner particles have a charge to mass ratio q, in absolute value, within the range $5\ \mu C/g \leqq \lvert q\rvert \leqq 8\ \mu C/g$.

6. The method according to claim 1, wherein said security features comprise fibers incorporated in said substrate.

7. The method according to claim 1, wherein said security features comprise watermarks.

8. The method according to claim 1, wherein said substrate has an average thickness and thickness variations, measured as $R_{max}$, of between 10% and 80% of the average thickness of said substrate.

9. The method according to claim 1, wherein said step of adjusting said spacing comprises the step of positioning said back electrode.

10. The method according to claim 1, wherein said step of adjusting said spacing comprises the step of positioning said printhead structure.

11. A direct electrostatic printing device for printing information on a substrate having security features, said device comprising:

a back electrode;

toner delivery means for delivering a flow toner particles towards said back electrode;

means for providing a DC potential difference ($DC_{TB}$) between said back electrode and said toner delivery means to create a flow of toner particles from said toner delivery means towards said back electrode;

a printhead structure, having printing apertures and control electrodes around said printing apertures, interposed between said toner delivery means and said back electrode and being spaced from said back electrode by a spacing having an adjustable width L in μm, for imagewise controlling said flow of toner particles;

means for passing a substrate, having thickness T in μm, through said spacing L between said back electrode and said printhead structure;

means for adjusting said width L such that $L \geqq 1.5\ T$; and means for fixing said toner particles to said substrate.

12. The device according to claim 11, wherein said means for adjusting said width L is a micrometer screw, a stepping motor, a lever system or interposed calibrated spacers.

13. The device according to claim 11, wherein L is greater than or equal to 750 μm.

14. The device according to claim 11, wherein L is greater than or equal to 1000 μm.

15. The device according to claim 11, wherein said toner particles have a charge to mass ratio, in absolute value, within the range $2\ \mu C/g \leqq \lvert q\rvert \leqq 15\ \mu C/g$.

16. The device according to claim 11, wherein said security features comprise fibers incorporated in said substrate.

17. The device according to claim 11, wherein said security features comprise watermarks.

18. The device according to claim 11, wherein said substrate has an average thickness and thickness variations, measured as $R_{max}$, of between 10% and 80% of the average thickness of said substrate.

* * * * *